US009168647B2

(12) United States Patent
Logan

(10) Patent No.: US 9,168,647 B2
(45) Date of Patent: Oct. 27, 2015

(54) AUTOMOBILE RIM HAMMER

(76) Inventor: Michael A. Logan, Brooklyn, NY (US)

( * ) Notice: Subject to any disclaimer, the term of this patent is extended or adjusted under 35 U.S.C. 154(b) by 1089 days.

(21) Appl. No.: 12/255,353

(22) Filed: Oct. 21, 2008

(65) Prior Publication Data

US 2010/0095809 A1 Apr. 22, 2010

(51) Int. Cl.
*B25D 1/00* (2006.01)
*B25G 1/01* (2006.01)

(52) U.S. Cl.
CPC .. *B25D 1/00* (2013.01); *B25G 1/01* (2013.01); *B25D 2222/24* (2013.01); *B25D 2222/36* (2013.01); *B25D 2250/295* (2013.01)

(58) Field of Classification Search
USPC ..... 81/20–22, 25–26; 420/563, 572
See application file for complete search history.

(56) References Cited

U.S. PATENT DOCUMENTS 1,704,208 A * 3/1929 Palm ..... 420/571
1,878,686 A * 9/1932 Ellis ..... 420/571
3,139,334 A * 6/1964 Fritz ..... 75/228
3,543,715 A * 12/1970 Hill ..... 81/20
3,930,525 A * 1/1976 Stoneburner ..... 81/19
4,376,093 A * 3/1983 Prengaman ..... 420/573
5,946,965 A 9/1999 Leone
6,450,583 B2 9/2002 Hale, Jr. et al.
2005/0158629 A1* 7/2005 Furukawa et al. ..... 429/245

OTHER PUBLICATIONS

"Pure Lead, Ingots, Remelted Lead Ingot, Secondary Lead Ingot, Lead Scrap, Pure Lead 9 . . . ", Gravita USA Inc., http://www.gravitausa.com/PureLead.html, uploaded Nov. 17, 2010, 2 pgs.

* cited by examiner

*Primary Examiner* — Monica Carter
*Assistant Examiner* — Melanie Alexander
(74) *Attorney, Agent, or Firm* — Graham Curtin, P.A.

(57) ABSTRACT

Methods and apparatus for removing a dent from an automobile rim are described herein. A hammer having a hammer head containing lead, antimony and aluminum is applied to pound an automobile rim. The dent is removed from the rim without breaking the rim. Different compounds of lead for the hammer head are provided. In one embodiment the hammer weighs between 10 and 12 pounds. In another embodiment the hammer head has a cylindrical shape. The hammer head may chip away during hitting the rim.

12 Claims, 2 Drawing Sheets

AUTOMOBILE RIM HAMMER

BACKGROUND OF THE INVENTION

This application generally relates to the field of automobile rim repair. More specifically, this application relates to methods and apparatus for removing dents from automobile rims.

Automobile rims are susceptible to damage, for example, when a car is driven into a pothole. Generally, automobile rims are very expensive. Custom rims or sets of rims on high-end automobiles can cost well over $1000 per set, or more. Currently, if a rim is dented or otherwise damaged, it usually must be replaced at great cost. There is no acceptable way to inexpensively remove dents from an automobile rim without breaking the rim. In areas with large or frequent potholes, the expense of replacing rims can make driving a high-end automobile a financial impossibility.

Therefore, a need for improved tools and methods to remove dents from an automobile rim without damaging the rim exists.

SUMMARY OF THE INVENTION

Embodiments of the invention are directed to automobile rim hammers comprising a head including a homogeneous mixture of metals and a shaft having a first end and a second end, the first end being affixed to the head, the shaft being adapted to support the weight of the head. The metals comprise aluminum, antimony and lead. An automobile rim does not break when struck with the hammer according to specific aspects.

Additional aspects of the invention further include a handle affixed the second end of the shaft. Detailed aspects include a padded handle.

Other specific aspects of the hammer have between about 0.005% and about 25% aluminum by weight. Further specific aspects have between about 75% and about 99.99% lead by weight. Additional specific aspects have between about 0.005% and about 10% antimony by weight.

In one preferred aspect, the automobile rim hammer contains a homogeneous mixture of metals comprising about 90% lead by weight, about 0.006% antimony by weight and about 10% aluminum by weight.

Additional embodiments of the invention are directed to methods of making an automobile rim hammer. The methods comprise melting metals including at least lead, antimony and aluminum; inserting a first end of a shaft into the melt, the shaft having a first end and second end into the melt; and cooling the melt. Some aspects further comprise applying a handle to the second end of the shaft.

Additional detailed aspects include mixing the metals to provide a homogeneous mixture. The metals may be mixed prior to melting, while still solid, or as part of the melting step.

Further embodiments of the invention are directed to methods of removing dents from an automobile rim, comprising hitting the rim with a head of a hammer, wherein the head comprises a homogeneous mixture of lead, antimony and aluminum. The hammer head of specific aspects comprises between about 75% and about 99.99% by weight lead, between about 0.005% and about 10% by weight antimony and between about 0.005% and about 25% by weight aluminum.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
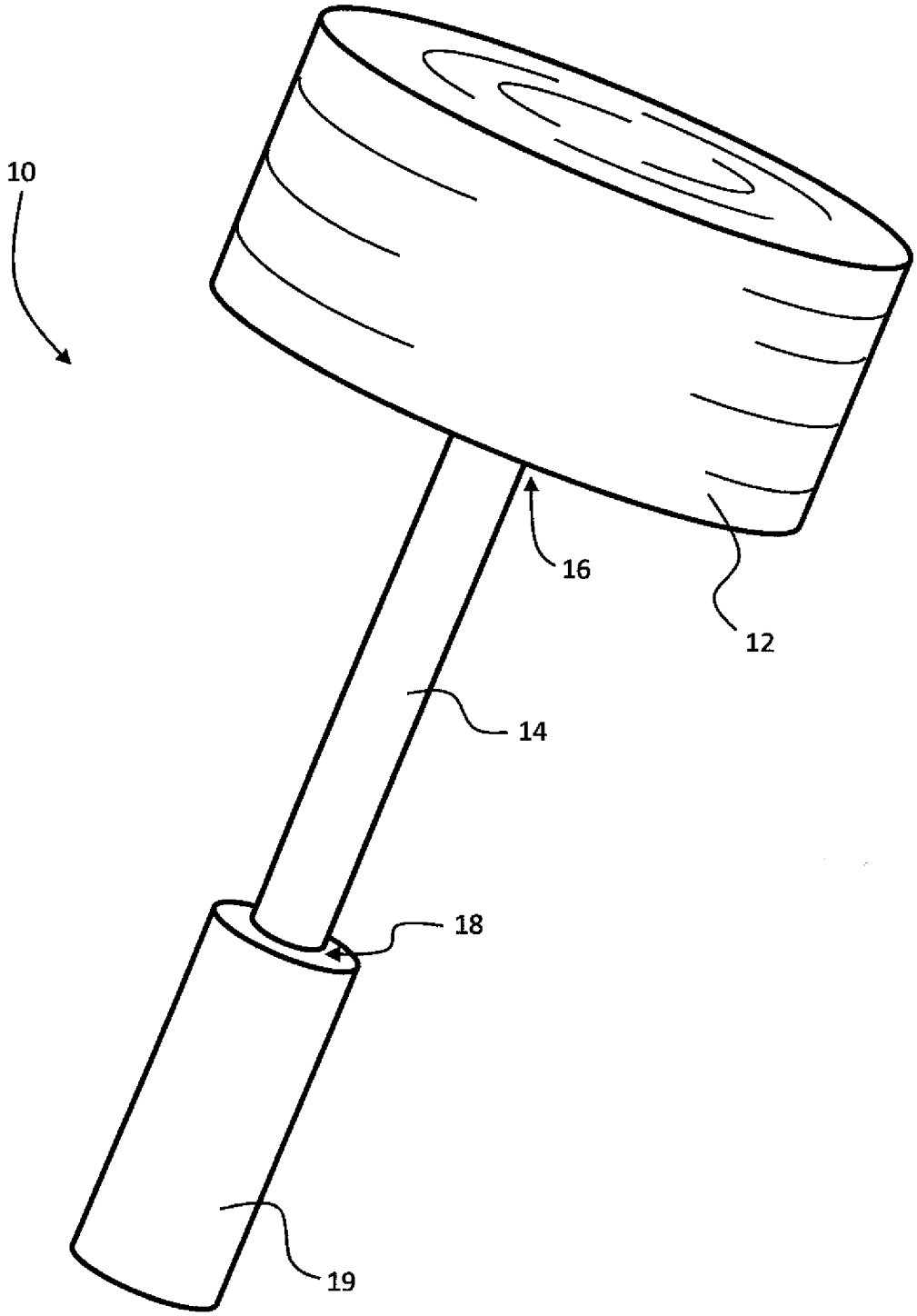
FIG. 1 shows an automobile rim hammer according to one or more aspects of the invention.

One or more embodiments of the invention are directed to automobile rim hammers which do not break the rim upon striking. An example hammer 10 is shown in FIG. 1. The hammer 10 comprises a head 12 and shaft 14. The head 12 includes a homogeneous mixture of metal comprising aluminum, antimony and lead. The shaft 14 has a first end 16 and a second end 18, with the first end 16 being affixed to the head 12. The shaft 14 is adapted to support the weight of the head 12. The first end 16 of the shaft 14 may be affixed to the head 12 by any suitable means known to those skilled in the art.

The head 12 of the hammer 10, when struck on a rim, may gradually chip away. Therefore, the head 12 of the hammer 10 breaks instead of the rim. The hammer 10 shown in FIG. 1 has a cylindrical head 12. The shape of the head 12 is not critical, and can be any shape suitable for hitting a rim. The shape of the head 12 shown may have the advantage of allowing the user to swing the hammer 10 without needing to aim the head 10. Hammers 10 with small heads 12 may be made for do-it-yourselfers while larger heads 12 may be more useful in commercial automotive repair facilities.

The hammer may weigh between about 10 and 12 pounds, but lighter or heavier hammers can also be used in accordance with the present invention, depending on the application. While the weight of the hammer is not critical, too light of a hammer will cause the user to swing the hammer very hard, whereas too heavy of a hammer may make the hammer hard to aim. The head of the hammer, formed by the metals, is preferably cylindrical having approximately a five to six inch diameter. Other sizes and dimensions can also be used.

Some aspects of the invention have a handle 19 affixed to the second end 18 of the shaft 14. The handle 19 may allow for a more comfortable grip and may absorb some shock associated with striking the hammer 10 on a rim. The handle 19 may be padded or have shock absorbing materials embedded therein.

According to one aspect of the invention, the automobile rim hammer has between about 0.005% and about 25% aluminum by weight. Other specific aspects have between about 75% and about 99.99% lead by weight. Further specific aspects have between about 0.005% and about 10% antimony by weight.

The automobile rim hammer of detailed aspects has between about 75% and about 99.99% lead by weight; between about 0.005% and about 10% antimony by weight; and between about 0.005% and about 25% aluminum by weight.

In accordance with one preferred embodiment of the present invention, the hammer head includes 98.7% lead by weight, less than 57 parts per million antimony and 71 parts per million aluminum. In accordance with another preferred embodiment of the present invention, the hammer head includes just under 100% lead by weight, less than 59 parts per million antimony and 94 parts per million aluminum.

Further detailed aspects of the hammer have a homogeneous mixture of metals comprising about 90% lead by weight, about 0.006% antimony by weight and about 10% aluminum by weight.

Additional embodiments of the invention are directed to methods of making an automobile rim hammer. The method includes melting metals comprising at least lead, antimony and aluminum. Inserting a first end of a shaft into the melt and allowing the melt to cool. Some detailed aspects homogenize the combined metals after they have been melted, where other aspects allow for the metals to be homogenized prior to melting.

In some aspects, a handle may be applied to the second end of the shaft. The handle may be padded or contain shock absorbing materials or structures to reduce vibration transmitted to the user.

Figure 2A:
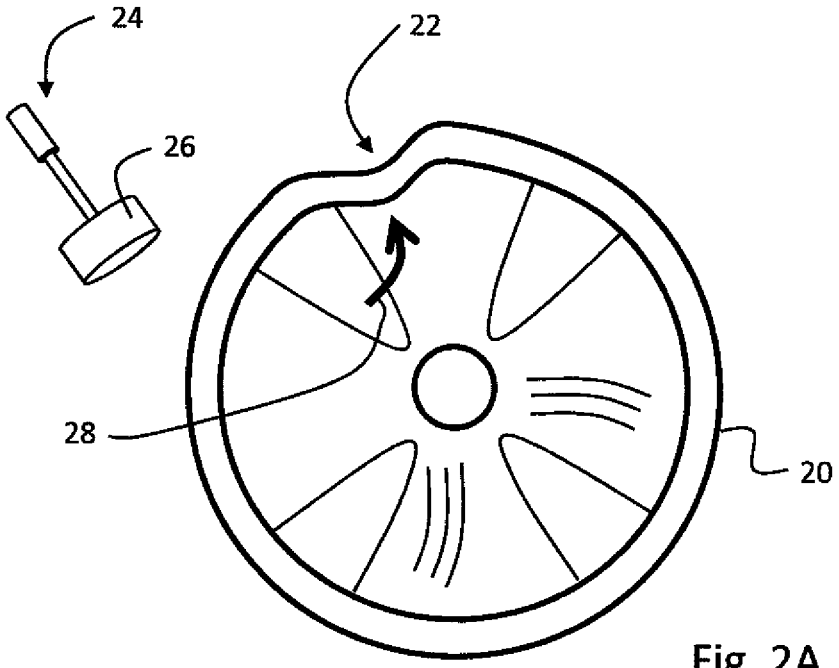
FIGS. 2A and 2B show steps for removing dents from an automobile rim according to aspects of the invention.
Figure 2B:
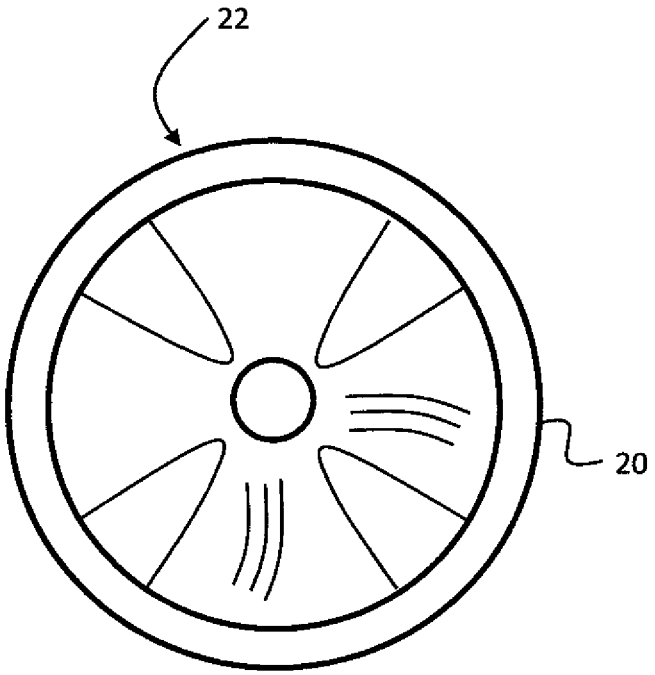

Further embodiments of the invention are directed to methods of removing dents from an automobile rim. As shown in FIG. 2A, an automobile rim 20 has a dent 22. The cause of the dent 22 is not important but may be the result of an accident, hitting a pothole, etc. The dent 22 is hit with a hammer 24 along arc 28. The hammer 24 has a head 26 comprising a homogeneous mixture of lead, antimony and aluminum. The head 26 of the hammer 24 may chip away as the dent 22 is pounded out of the rim 20. FIG. 2B shows the rim of FIG. 2A after the dent has been removed by pounding with the hammer 24 of various aspects of the invention.

The hammer of the present invention provides superior and unexpected performance when used to repair automobile rims, particularly today's fragile automobile rims. Previously, many damaged rims were not repairable, but these rims can be repaired using the hammer of the present invention.

Reference throughout this specification to "one embodiment," "certain embodiments," "one or more embodiments," "an embodiment," "one aspect," "certain aspects," "one or more embodiments" and "an aspect" means that a particular feature, structure, material, or characteristic described in connection with the embodiment is included in at least one embodiment of the invention. Thus, the appearances of the phrases such as "in one or more embodiments," "in certain embodiments," "in one embodiment," "in an embodiment," "according to one or more aspects," "in an aspect," etc., in various places throughout this specification are not necessarily referring to the same embodiment or aspect of the invention. Furthermore, the particular features, structures, materials, or characteristics may be combined in any suitable manner in one or more embodiments or aspects. The order of description of the above method should not be considered limiting, and methods may use the described operations out of order or with omissions or additions.

It is to be understood that the above description is intended to be illustrative, and not restrictive. Many other embodiments will be apparent to those of ordinary skill in the art upon reviewing the above description. The scope of the invention should, therefore, be determined with reference to the appended claims, along with the full scope of equivalents to which such claims are entitled.

As used in this specification and the appended claims, the singular forms "a", "an" and "the" include plural referents unless the context clearly indicates otherwise.

What is claimed is:

1. An automobile rim hammer, comprising:

a head with a cylindrical surface between a first end and a second end including a homogeneous mixture of metals, the metals comprising:

between 0.005% and 25% aluminum by weight;

between 0.005% and 10% antimony by weight; and between 75% and 99.99% lead by weight;

a shaft having a first end and a second end, the first end of the shaft being affixed to the first end of the head, the shaft being adapted to support the weight of the head;

wherein the hammer weights between 10 and 12 pounds;

wherein the cylinder has a diameter in the range of about 5 inches to about 6 inches: and wherein the automobile rim hammer is adapted to chip away during removal of a dent in an automobile rim.

2. The automobile rim hammer of claim 1, further comprising a handle affixed to the second end of the shaft.

3. The automobile rim hammer of claim 2, wherein the handle is padded.

4. The automobile rim hammer of claim 1, wherein an automobile rim does not break when struck with the hammer.

5. The automobile rim hammer of claim 1, wherein there is between about 0.01% and about 25% aluminum by weight.

6. The automobile rim hammer of claim 1, wherein there is between about 75% and 99% lead by weight.

7. The automobile rim hammer of claim 1, wherein there is between about 0.01% and about 10% antimony by weight.

8. The automobile rim hammer of claim 1, where the homogeneous mixture of metals comprises:

about 90% lead by weight;

about 0.006% antimony by weight; and about 10% aluminum by weight.

9. The automobile rim hammer of claim 2, wherein the handle comprises a shock absorbing material.

10. The automobile rim hammer of claim 1, wherein the metals comprise:

about 98.7% lead by weight;

about 57 parts per million antimony; and about 71 parts per million aluminum by weight.

11. The automobile rim hammer of claim 1, wherein the metals comprise:

about 90% lead by weight;

about 0.006% antimony by weight; and about 10% aluminum by weight.

12. The automobile rim hammer of claim 1, wherein the automobile rim hammer is effective for removing dents from an automobile rim without breaking the automobile rim.

* * * * *